US007361440B2

(12) United States Patent
Mishra et al.

(10) Patent No.: US 7,361,440 B2
(45) Date of Patent: Apr. 22, 2008

(54) ANTICURL BACKING LAYER FOR ELECTROSTATOGRAPHIC IMAGING MEMBERS

(75) Inventors: Satchidanand Mishra, Webster, NY (US); Satish Parikh, Rochester, NY (US); Anthony M. Horgan, Pittsford, NY (US); Kathleen Carmichael, Williamson, NY (US); Markus Silvestri, Fairport, NY (US); Edward Grabowski, Webster, NY (US); Donald Goodman, Pittsford, NY (US); Richard Post, Penfield, NY (US); Kenny-tuar Dinh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 359 days.

(21) Appl. No.: 11/199,842

(22) Filed: Aug. 9, 2005

(65) Prior Publication Data

US 2007/0037081 A1 Feb. 15, 2007

(51) Int. Cl.
*G03G 5/10* (2006.01)

(52) U.S. Cl. ..... 430/69; 430/127

(58) Field of Classification Search ..... 430/69, 430/127

See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,654,284 | A | 3/1987 | Yu et al. |
| 4,664,995 | A | 5/1987 | Horgan et al. |
| 4,988,597 | A | 1/1991 | Spiewak et al. |
| 5,021,309 | A | 6/1991 | Yu |
| 5,069,993 | A | 12/1991 | Robinette et al. |
| 5,244,762 | A | 9/1993 | Spiewak et al. |
| 5,697,024 | A | 12/1997 | Mishra |
| 5,703,487 | A | 12/1997 | Mishra |
| 5,756,245 | A | 5/1998 | Esteghamatian et al. |
| 5,919,590 | A | 7/1999 | Yu et al. |
| 6,008,653 | A | 12/1999 | Popovic et al. |
| 6,119,536 | A | 9/2000 | Popovic et al. |
| 6,124,514 | A | 9/2000 | Emmrich et al. |
| 6,150,824 | A | 11/2000 | Mishra et al. |
| 6,528,226 | B1 | 3/2003 | Yu et al. |
| 2004/0018440 | A1 | 1/2004 | Lin et al. |
| 2004/0115545 | A1 | 6/2004 | Horgan et al. |
| 2004/0126684 | A1 | 7/2004 | Horgan et al. |
| 2005/0053854 | A1 | 3/2005 | Pai et al. |
| 2005/0233230 | A1* | 10/2005 | Carmichael et al. ..... 430/56 |

* cited by examiner

*Primary Examiner*—John L Goodrow
(74) *Attorney, Agent, or Firm*—Pillsbury Winthrop Shaw Pittman LLP

(57) ABSTRACT

The presently disclosed embodiments are directed to anticurl backing layers useful in electrostatography. More particularly, the embodiments pertain to an electrostatographic imaging member with an improved anticurl backing layer including a low surface energy polymeric material to prevent curling and reduce friction, and a process for making and using the member.

16 Claims, 1 Drawing Sheet

FIG. 1
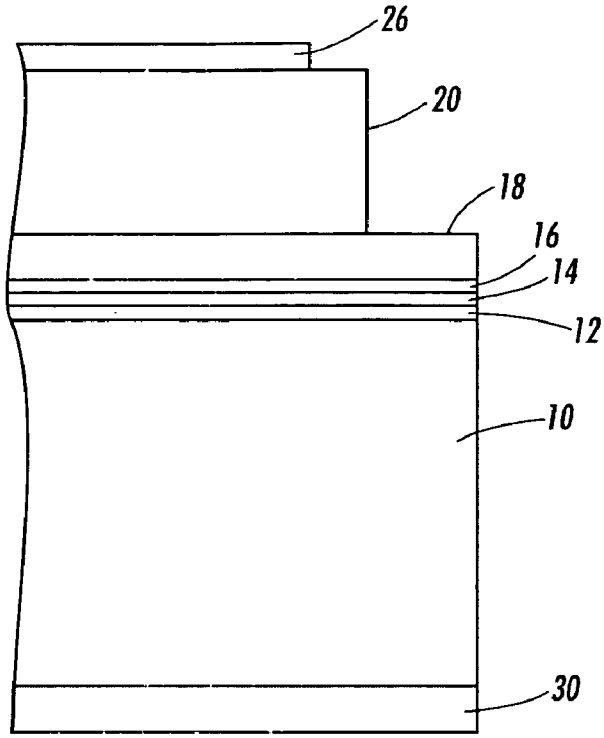
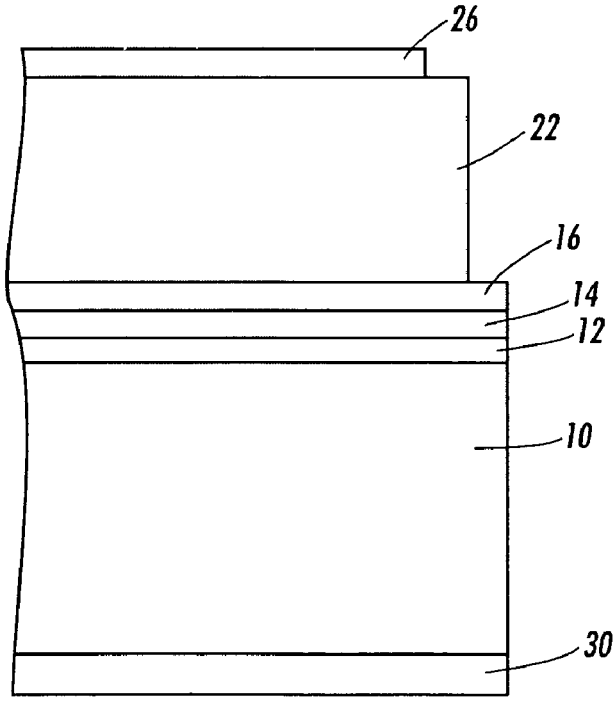
FIG. 2

ANTICURL BACKING LAYER FOR ELECTROSTATOGRAPHIC IMAGING MEMBERS

BACKGROUND

The presently disclosed embodiments are directed to an imaging member used in electrostatography. More particularly, the embodiments pertain to an electrostatographic imaging member with an improved anticurl backing layer comprising a low surface energy polymeric material and a process for making and using the member.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. The electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of Gen layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoating layer adjacent to another edge of the imaging layers. Such a photoreceptor usually further comprises an anticurl backing layer on the side of the substrate opposite the side carrying the conductive layer, support layer, blocking layer, adhesive layer, charge generating layer, CTL and other layers.

After applying the various coating for the multilayered organic photoconductors, the resulting web tends to spontaneously "curl" once the coating solvents evaporate. Curl is primarily due to dimensional contraction of the applied CTL coating from the point in time when the applied CTL coating solidifies and adheres to the underlying surface. Once this solidification and adhesion point is reached, the evaporation of coating solvent further causes continued shrinking of the applied CTL coating due to volume contraction. Removal of additional solvent will cause the coated web to curl toward the applied CTL, because the substrate (often polyethylene terephthalate) does not undergo any dimensional changes. This shrinking occurs isotropically, e.g., three-dimensionally.

Curling of a photoreceptor web is undesirable because it hinders fabrication of the web into cut sheets and subsequent welding into a belt. An anticurl backing layer having a curl equal to and in the opposite direction to the applied layers is applied to the reverse side of the active photoreceptor to eliminate the overall curl of the coated device by counteracting the curl due to the mismatch of the thermal expansion of the photoreceptor substrate and the CTL. The anticurl backing layer counter compensates the curl so as to promote the photoreceptor to lay flat. However, common anticurl backing layer formulations are not always sufficient in the larger, more complex systems.

Curling is also undesirable because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Coatings may be applied to the side of the supporting substrate opposite the photoconductive layer to counteract the tendency to curl, however, difficulties have been encountered with these anticurl coatings. Anticurl layers will also occasionally delaminate due to poor adhesion to the supporting substrate. Delamination is particularly troublesome in high speed automatic copiers, duplicators and printers which require extended cycling of the photoreceptor belt. For example, delamination has occurred in as few as 8,000 cycles. Moreover, delamination is accelerated when the belts are cycled around small diameter rollers and rods.

Since the anti-curl coating is an outermost exposed layer, it has further been found that during cycling of the photoconductive imaging member in electrophotographic imaging systems, the relatively rapid wearing away of the anti-curl coating also results in the curling of the photoconductive imaging member. In some tests, the anti-curl coating was completely removed in 150 thousand to 200 thousand cycles. This problem is even more pronounced when photoconductive imaging members in the form of webs or belts are supported in part by stationary guide surfaces which causes the anti-curl layer to wear away very rapidly and produce debris which scatters and deposits on critical machine components such as lenses, corona charging devices and the like, thereby adversely affecting machine performance.

In other machines the electrostatic charge builds up due to contact friction between the anti-curl layer and the backer bars. The charge increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. In other cases, the electrostatic charge build up can be so high as to cause sparking.

Many attempts have been made to overcome the above problems but not without leading to additional problems. For example, although the addition of micro-crystalline silica, at a 10 weight percent level in the anti-curl layer has been found to decrease charge transport layer/anti-curl layer surface contact friction, excessive welding horn wear is observed when this electrophotographic imaging member belt is fabricated by the ultrasonically welding of overlapped ends of an imaging member sheet. It also can cause excessive wear of backer bars.

Another problem encountered in the conventional belt photoreceptors using a bisphenol A polycarbonate anti-curl backing layer that are extensively cycled in precision electrostatographic imaging machines utilizing belt supporting backer bars, is an audible squeaky sound generated due to high contact friction interaction between the anti-curl layer and the backer bars. Further, cumulative deposition of anti-curl layer debris onto the backer bars may give rise to undesirable defect print marks formed on copies which forces the photoreceptor upwardly and interferes with the toner image development process. On other occasions, the anti-curl layer wear causes debris accumulation on the backer bars to gradually increase the dynamic contact friction between these two interacting surfaces, interfering with the duty cycle of the driving motor to a point where the motor eventually stalls and belt cycling prematurely ceases.

A known anticurl backing layer used in the printing apparatuses includes polytetrafluoroethylene (PTFE) dispersed in polymer binder solution. PTFE is commonly incorporated to reduce the friction of the photoreceptor to the backer bars. This formulation, however, is unable to address the friction in larger copiers or printers because of a problem with stability of the coating solution. PTFE forms an unstable dispersion in a polymer solution, commonly a bisphenol A polycarbonate polymer solution, and tends to settle in the mix tanks if not continuously stirred. The dispersion problem can result in an anticurl backing layer with insufficient and variable PTFE along the length of the coated web, and thus, inadequate reduction of friction over the backer bars in the copiers or printers. This causes significant complications in the larger copiers or printers, which often include so many backer bars that the high friction increases the torque needed to drive the belt. Consequently, two driving rollers are included and synchronized to prevent any misregistration. The additional components result in high costs for producing and using these larger printing apparatuses. Thus, if the friction could be reduced, the apparatus design in these larger printing apparatuses could be simplified with less components, resulting in significant cost savings. The inventions discussed above also contemplate dispersion of other particles, such as silica or PTFE in the solution of polymeric binder. However, these generally have a problem of instability of solutions and thus the shelf life, and consequently, needs to be constantly stirred. The pure polymeric binder solution does not have the stability problem but does have other problems, as discussed above.

In U.S. Pat. No. 5,069,993, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309 shows an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 5,919,590 shows An electrostatographic imaging member comprising a supporting substrate having an electrically conductive layer, at least one imaging layer, an anti-curl layer, an optional ground strip layer and an optional overcoating layer, the anti-curl layer including a film forming polycarbonate binder, an optional adhesion promoter, and optional dispersed particles selected from the group consisting of inorganic particles, organic particles, and mixtures thereof.

In U.S. Pat. No. 4,654,284 an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226 a process for preparing an imaging member is disclosed that includes applying an organic layer to an imaging member substrate, treating the organic layer and/or a backside of the substrate with a corona discharge effluent, and applying an overcoating layer to the organic layer and/or an anticurl backing layer to the backside of the substrate.

Thus, electrostatographic imaging members comprising a supporting substrate, having a conductive surface on one side, coated over with at least one photoconductive layer and coated on the other side of the supporting substrate with an anti-curl layer, may exhibit deficiencies which are undesirable in advanced automatic, cyclic electrostatographic copiers, duplicators, and printers. While the above mentioned electrostatographic imaging members may be suitable for their intended purposes, further improvement on these electroreceptors are desirable. For example, there continues to be the need for improvements in such systems, particularly for an imaging member that includes an improved anticurl backing layer that sufficiently counters curling and reduces friction, even in larger printing apparatuses.

SUMMARY

According to aspects illustrated herein, there is provided an anticurl backing layer that addresses the shortcomings of traditional anticurl backing layers discussed above.

An embodiment may include an electrostatographic imaging member comprising a substrate with a conducting layer, at least one imaging layer positioned on a first side of the substrate, an anticurl backing layer positioned on a second side of the substrate opposite to the at least one imaging layer, where the anticurl backing layer includes a low surface energy modified polycarbonate polymer formed from a monomer selected from the group consisting of modified Bisphenol A polycarbonate poly(4,4'-isopropylidene diphenyl carbonate) and a modified Bisphenol Z polycarbonate poly (4,4'-diphenyl-1-1'cyclohexane carbonate), the polymer having a viscosity molecular weight of from about 39,000 to about 76,000, and an optional adhesive promoter, an optional over coating layer on the at least one imaging layer, and an optional ground strip layer on the at least one imaging layer.

Another embodiment may include a process for making a flexible electrostatographic imaging member comprising providing a substrate with a conducting layer, forming at least one imaging layer on a first side of the substrate, forming an anticurl backing layer on a second side of the substrate opposite to the at least one imaging layer, where the anticurl backing layer includes a low surface energy modified polycarbonate polymer formed from a monomer selected from the group consisting of modified Bisphenol A polycarbonate poly(4,4'-isopropylidene diphenyl carbonate) and a modified Bisphenol Z polycarbonate poly (4,4'-diphenyl-1-1'cyclohexane carbonate), the polymer having a viscosity molecular weight of from about 39,000 to about 76,000, and an optional adhesive promoter, forming an optional over coating layer on the at least one imaging layer, and forming an optional ground strip layer on the at least one imaging layer.

BRIEF DESCRIPTION OF THE DRAWINGS

For a better understanding of the present invention, reference may be had to the accompanying figures.

FIG. 1 is a cross-sectional view of a multilayered electrophotographic imaging member according to an embodiment of the invention.

FIG. 2 is a cross-section view of a multilayered electrophotographic imaging member according to another embodiment of the invention.

DETAILED DESCRIPTION

In the following description, reference is made to the accompanying drawings, which form a part hereof and which illustrate several embodiments of the present invention. It is understood that other embodiments may be utilized and structural and operational changes may be made without departure from the scope of the present invention.

An exemplary embodiment of a multilayered electrophotographic imaging member of flexible belt configuration is illustrated in FIG. 1. The exemplary imaging member includes a support substrate 10 having an optional conductive surface layer or layers 12 (which may be referred to herein as a ground plane layer) optional if the substrate itself is conductive, a hole blocking layer 14, an optional adhesive interface layer 16, a charge generating layer 18 and a charge transport layer 20, and optionally one or more overcoat and/or protective layer 26. The charge generating layer 18 and the charge transport layer 20 forms the imaging layer described here as two separate layers, it will be appreciated that the functional components of these layers may alternatively be combined into a single layer.

Other layers of the imaging member may include, for example, an optional ground strip layer 28, applied to one edge of the imaging member to promote electrical continuity with the conductive layer 12 through the hole blocking layer 14. An anticurl back coating layer 30 of the present invention may be formed on the backside of the support substrate 10. The conductive ground plane 12 is typically a thin metallic layer, for example a 10 nanometer thick titanium coating, deposited over the substrate 10 by vacuum deposition or sputtering process. The layers 14, 16, 18, 20 and 26 may be separately and sequentially deposited on to the surface of conductive ground plane 12 of substrate 10 as solutions comprising a solvent, with each layer being dried before deposition of the next.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 the substrate may have a number of many different configurations, such as, for example, a plate, a drum, a scroll, an endless flexible belt, and the like. In one embodiment, the substrate is in the form of a seamed flexible belt.

The thickness of the substrate 10 depends on numerous factors, including flexibility, mechanical performance, and economic considerations. The thickness of the support substrate 10 may range from about 50 micrometers to about 3,000 micrometers. In embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 10 is not soluble in any of the solvents used in each coating layer solution, is optically transparent, and is thermally stable up to a high temperature of about 150° C. A typical substrate support 10 used for imaging member fabrication has a thermal contraction coefficient ranging from about $1\times10^{-5}$° C. to about $3\times10^{-5}$° C. and a Young's Modulus of between about $5\times10^{-5}$ psi ($3.5\times10^{4}$ Kg/cm2) and about $7\times10^{-5}$ psi ($4.9\times10^{-4}$ Kg/cm2).

The Conductive Layer

The conductive ground plane layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 12 comprising an electrically conductive material, such as titanium or titanium/zirconium, coating over the substrate layer 10.

The Hole Blocking Layer

A hole blocking layer 14 may then be applied to the substrate 10 or to the layer 12, where present. Any suitable positive charge (hole) blocking layer capable of forming an effective barrier to the injection of holes from the adjacent conductive layer 12 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino) titanate, titanium-4-amino benzene sulfonate oxyacetate, titanium 4-aminobenzoate isostearate oxyacetate, (gamma-aminobutyl) methyl diethoxysilane which has the formula [H2N(CH2)4]CH3Si(OCH3)2, and (gamma-aminopropyl) methyl diethoxysilane, which has the formula [H2N(CH2)3]CH33Si(OCH3)2, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The interface layer may include a copolyester resin. Exemplary polyester resins which may be utilized for the interface layer include polyarylatepolyvinylbutyrals, such as ARBEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. In yet other embodiments, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure. thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 10 and also a transparent conductive layer 12, image wise exposure or erase may be accomplished through the substrate 10 with all light passing through the back side of the substrate. In this case, the materials of the layer 20 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The charge transport layer 20 should trap minimal charges as the charge pass through it during the printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1 '-biphenyl]4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl) methanes, as described, for example, in U.S. Pat. No. 3,820,989. The disclosures of all of these patents are incorporated herein be reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. application Ser. No. 10/736,864, filed Dec. 16, 2003, entitled "Imaging Members," by Anthony M. Horgan, et al., which was published on Jul. 1, 2004, as application Ser. No. 2004/0126684; U.S. application Ser. No. 10/320,808, filed Dec. 16, 2002, entitled "Imaging Members," by Anthony M. Horgan, et al., which was published on Jun. 17, 2004, as application Ser. No. 2004/0115545, and U.S. application Ser. No. 10/655,882, filed Sep. 5, 2003, entitled "Dual charge transport layer and photoconductive imaging member including the same," by Damodar M. Pai, et al., which was published on Mar. 10, 2005 as application Ser. No. 2005/0053854, the disclosures of which are incorporated herein by reference in their entireties.

In one exemplary embodiment, layer 20 comprises an average of about 10-60 weight % N,N'-diphenyl-N,N'-bis(3-methylphenyl)-1,1'-biphenyl-4,4'-diamine, such as from about 30-50 weight % N,N'-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrocinnamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

In one specific embodiment, the charge transport layer 20 is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a poly(4,4'-isopropylidene diphenyl carbonate) or a poly(4,4'-diphenyl-1,1'-cyclohexane carbonate). The charge transport layer may have a Young's Modulus in the range of from about $2.5\times10^{-5}$ psi ($1.7\times10^{-4}$ Kg/cm2) to about $4.5\times10^{-5}$ psi ($3.2\times10^{-4}$ Kg/cm2) and a thermal contraction coefficient of between about $6\times10^{-5\circ}$ C. and about $8\times10^{-5\circ}$ C.

The thickness of the charge transport layer 20 can be from about 5 micrometers to about 200 micrometers, e.g., from between about 15 micrometers and about 40 micrometers. The charge transport layer may comprise dual layers or multiple layers with different concentration of charge transporting components.

Other layers such as conventional ground strip layer including, for example, conductive particles dispersed in a film forming binder may be applied to one edge of the imaging member to promote electrical continuity with the conductive layer 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

Optionally, an overcoat layer 26, if desired, may also be utilized to provide imaging member surface protection as well as improve resistance to abrasion.

The Overcoat Layer

Additional aspects relate to inclusion in the charge transport layer or to an overcoat layer 26 of nano particles as a dispersion, such as silica, metal oxides, ACUMIST (waxy polyethylene particles), PTFE, and the like. The nanoparticles may be used to enhance the lubricity and wear resistance of the charge transport layer 20. The particle dispersion concentrated in the top vicinity of the transport layer 20 can be up to about 10 weight percent of the weight or one tenth thickness of the charge transport layer 20 to provide optimum wear resistance without causing a deleterious impact on the electrical properties of the fabricated imaging member. Where an overcoat layer 26 is employed, it may comprise a similar resin used for the charge transport layer or a different resin and be from about 1 to about 2 microns in thickness.

Since the charge transport layer 20 can have a substantial thermal contraction mismatch compared to that of the substrate support 10, the prepared flexible electrophotographic imaging member may exhibit spontaneous upward curling due to the result of larger dimensional contraction in the charge transport layer 24 than the substrate support 10, as the imaging member cools down to room ambient temperature after the heating/drying processes of the applied wet charge transport layer coating. An anti-curl back coating 30 can be applied to the back side of the substrate support 10 (which is the side opposite the side bearing the electrically active coating layers) in order to render flatness.

The multilayered, flexible electrophotographic imaging member web stocks fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

As an alternative to separate charge transport 20 and charge generation layers 18, a single imaging layer 22 may be employed, as shown in FIG. 2, with other layers of the photoreceptor being formed as described above. The imaging layer 22 may comprise a single electrophotographically active layer capable of retaining an electrostatic charge in the dark during electrostatic charging, imagewise exposure and image development, as disclosed, for example, in U.S. application Ser. No. 10/202,296, filed Jul. 23, 2002, entitled "Imaging Members," by Liang-Bih Lin, et al., published Jan. 29, 2004, as application Ser. No. 2004/0018440. The single imaging layer 22 may include charge transport molecules in a binder, similar to those of the charge transport layer 20 and optionally may also include a photogenerating/photoconductive material, similar to those of the layer 18 described above.

The prepared flexible imaging belt may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The electrostatographic device can be evaluated by printing in a marking engine into which a photoreceptor belt formed according to the exemplary embodiment has been installed For intrinsic electrical properties it can also be investigated by conventional electrical drum scanners. Alternatively, the reduction in charge deficient spots can be evaluated using electrical techniques, such as those disclosed in U.S. Pat. Nos. 5,703,487; 5,697,024; 6,008,653; 6,119,536; 6,150,824 and 5,703,487, which are incorporated herein in their entireties by reference.

Generally, anticurl backing layers comprise a polymer and an adhesive dissolved in a solvent and coated on the reverse side of the active photoreceptor. The anticurl backing layer must adhere to the polyethylenenaphthalate (PEN) substrate of the photoreceptor, for the life of the photoreceptor, while being subjected to xerographic cycling over rollers and backer bars within the copier or printer.

In one embodiment of the invention, the anticurl backing layer 30 may be comprised of a low surface energy polymer, the polymer being a modified Bisphenol A polycarbonate poly(4,4'-isopropylidene diphenyl carbonate) or a modified Bisphenol Z polycarbonate poly (4,4'-diphenyl-1-1'cyclohexane carbonate) and having a range of viscosity molecular weights of 39,000 to 76,000 (available from Mitsubishi Gas Chemical Co.) and an adhesive. Bisphenol Z and bisphenol A are chemical building blocks that are used primarily to make polycarbonate plastic and epoxy resins. A bisphenol A polycarbonate polymer is available as MAKROLON from Bayer Corp. (Wilmington, Mass.). In the alternative, other low surface energy polymers can be used in embodiments of the present invention, such as siloxane-containing polycarbonates. Such a polycarbonate is available from General Electric (Fairfield, Conn.) as the LEXAN EXL resin series. The adhesive may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments.

A generic anticurl backing layer formulation is a 92:8 ratio of polymer to adhesive dissolved at 9 percent by weight in a solvent. Specifically, the formulation may be 92:8 ratio of MAKROLON polymer to VITEL PE2200 adhesive. The polymer and adhesive may be dissolved at 9 percent by weight in a solvent of methylene chloride. In alternative embodiments of the present invention, the polymer to adhesive ratio may be changed and the weight percentage of solids dissolved in the solvent may also be changed. In the invention, the MAKROLON polymer will be substituted with low surface energy polymers, such as for example, the modified polycarbonate polymers or siloxane-containing polycarbonates.

For reasons of convenience, the invention will be described for electrophotographic imaging members in flexible belt form even though this invention includes electrostatographic imaging members having similar configurations.

Electrostatographic flexible belt imaging members are well known in the art. Typically, a flexible substrate is provided having an electrically conductive surface. For electrophotographic imaging members, at least one photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a CTL is subsequently formed on the charge generation layer. For ionographic imaging members, an electrically insulating dielectric imaging layer is applied to the electrically conductive surface. The substrate contains an anticurl backing layer on the side opposite from the side bearing the CTL or dielectric imaging layer.

A polymer with lower surface energy than those currently used in anticurling backing layers (e.g., bisphenol A polycarbonate polymers) is more to adequately reduce friction in the larger printing apparatuses. The use of such a polymer will substantially eliminate the need for PTFE in anticurling backing layer formulations. In the larger printing apparatuses, the use of such a low surface energy polymer will remove the need for additional components, and subsequently reduce the cost of the photoreceptor.

The polymer commonly used in the art is a bisphenol A based polymer. Embodiments of the present invention include four copolymers of various molecular weights and surface energies. All of these copolymers have surface energy less than bis-Phenol A based polymers, as shown by measurements via contact angle measurements shown below in TABLE 1 of Example I. The contact angle, q, is a quantitative measure of the wetting of a solid by a liquid. It is defined geometrically as the angle formed by a liquid at the three phase boundary where a liquid, gas and solid intersect. Another way to characterize a solid surface is by calculating free surface energy, also referred to as "solid surface tension." This approach involves testing the particular solid against a series of well-characterized wetting liquids. The liquids used must be characterized such that the polar and dispersive components of their surface tensions are known.

Each of the four copolymers may be obtained from Mitsubishi Gas Chemical Corporation (Tokyo, Japan), and referred to as FPC0540UA, FPC0550UA, FPC0580UA, and FPC0170UA. The low surface energy polymers are modified Bisphenol A polycarbonate poly(4,4'-isopropylidene diphenyl carbonate) or a modified Bisphenol Z polycarbonate poly (4,4'-diphenyl-1-1'cyclohexane carbonate) and having a range of viscosity molecular weights of 39,000 to 76,000. The viscosity of these low surface energy polymers ranges from 22 to 920 centipoise (cp) when dissolved in a solution, such as methylene chloride, where the polymer is 15 percent of the total solution. The viscosity is dependent on molecular weight. In other embodiments, the low surface energy polymer may be siloxane-containing polycarbonates such as the LEXAN EXL series available from General Electric. Viscosity of the polymer solution may impact the particular method of extrusion coating the anticurl backing layer onto the photoreceptor. Coating defects caused from using low viscosity solutions include Maragoni Cells, mottle, runback, streaks, nonuniform thickness across the width of the web, and the like.

The anticurl backing layer of this invention is applied to the rear side of the substrate to provide flatness. The compositions for anticurl backing layers are well known in the art and may comprise thermoplastic organic polymers or inorganic polymers that are electrically insulating or slightly semi-conductive.

Any suitable and conventional technique may be utilized to mix and thereafter apply the anticurl backing layer mixture to the supporting substrate layer. Typical application techniques include, for example extrusion coating, draw bar coating, roll coating, wire wound rod coating, and the like. The anticurl backing layer may be formed in a single coating step or in multiple coating steps.

Drying of the deposited coating may be effected by any suitable conventional technique such as oven drying, infra red radiation drying, air drying and the like. The thickness of the anti-curl layer after drying depends on the degree of photoconductive imaging member curling caused by the charge transport layer. The thickness is from about 3 micrometers to about 35 micrometers, and preferably about 18 micrometers.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

The process of this invention for fabricating the flexible electrostatographic imaging webs described above and in the Examples below comprises providing a substrate layer having a first side and a second side, and at least a first parallel side and a second parallel side. The substrate may further include a conducting layer. The process includes forming at least one imaging layer on the first side of the substrate, and forming a low surface energy anticurl backing layer on the second side of the substrate. The anticurl backing layer includes a low surface energy modified polycarbonate polymer formed from a monomer selected from the group consisting of modified Bisphenol A polycarbonate poly(4,4'-isopropylidene diphenyl carbonate) and a modified Bisphenol Z polycarbonate poly (4,4'-diphenyl-1-1'cyclohexane carbonate) and has a viscosity molecular weight of from about 39,000 to about 76,000. The polymer may also further include an optional adhesive promoter. The anticurl backing layer may be formed by extrusion of anticurl coating material through a single die nozzle onto the second major side of the substrate layer. Additionally, there may also be included steps for forming an optional over coating layer on the at least one imaging layer, as well as for forming an optional ground strip layer on the at least one imaging layer.

All the patents and applications referred to herein are hereby specifically, and totally incorporated herein by reference in their entirety in the instant specification.

EXAMPLES

The examples set forth hereinbelow and are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

Example 1

Four polymers were obtained from Mitsubishi Gas Chemical Corporation (MGC). The properties, provided by MGC, of the four polymers compared to MAKROLON 5705 manufactured by Farbenfabriken Bayer A.G are in Table 1

TABLE 1

| Polymer | Monomer used in synthesis | Mw as measured by MGC | Contact Angle with water as measured by MGC |
|---|---|---|---|
| FPC0540UA | BisPhenol-Z | 39500 | 96 |
| FPC0550UA | BisPhenol-Z | 53000 | 95 |
| FPC0580UA | BisPhenol-Z | 75100 | 97 |
| FPC05170UA | BisPhenol-A | 68200 | 98 |
| Control MAKROLON 5705 | BisPhenol-A | 66900 | 89 |

Control Example 2

An imaging member was prepared by providing a 0.02 micrometer thick titanium layer coated on a biaxially oriented polyethylene naphthalate substrate (KALEDEX 2000) having a thickness of 3.5 mils. Applied thereon with a gravure applicator, was a solution containing 50 grams 3-amino-propyltriethoxysilane, 41.2 grams water, 15 grams acetic acid, 684.8 grams of 200 proof denatured alcohol and 200 grams heptane. This layer was then dried for about 2 minutes at 120° C. in the forced air drier of the coater. The resulting blocking layer had a dry thickness of 500 Angstroms. An adhesive layer was then prepared by applying a wet coating over the blocking layer, using a gravure applicator, containing 0.2 percent by weight based on the total weight of the solution of polyarylate adhesive (ARDEL D100 available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 angstroms.

A photogenerating layer dispersion was prepared by introducing 0.45 grams of IUPILON 200 (PC-Z 200) available from Mitsubishi Gas Chemical Corporation and 50 ml of tetrahydrofuran into a 4 oz. glass bottle. To this solution was added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil. The charge generation layer was dried at 120° C. for 1 minute in a forced air oven to form a dry charge generation layer having a thickness of 0.4 micrometer.

This photogenerator layer was overcoated with a charge transport layer. The charge transport layer was prepared by introducing into an amber glass bottle in a weight ratio of 50:50 N,N'-diphenyl-N,N'-bis(3-methylphenyl)-1,1'-biphenyl-4,4'-diamine and MAKROLON 5705, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the photogenerator layer using a Bird applicator to form a coating which upon drying had a thickness of 14.5 microns. During this coating process the humidity was equal to or less than 15 percent. This charge transport layer was overcoated with a second charge transport layer. The second charge transport layer was prepared by introducing into an amber glass bottle in a weight ratio of 50:50 N,N'-diphenyl-N,N'-bis(3-methylphenyl)-1,1'-biphenyl-4,4'-diamine and MAKROLON 5705, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the photogenerator layer using a Bird applicator to form a coating which upon drying had a thickness of 14.5 microns. During this coating process the humidity was equal to or less than 15 percent.

An anticurl coating was applied to the rear surface (side opposite of the photogenerator layer and charge transport layer). An anticurl dispersion was prepared by introducing 5.28 grams of PE2200 available from Bostik Inc. and 66 gm of methylene chloride into a 4 oz. glass bottle. To this solution was added 6.98 grams of PTFE MP1100 available from DuPont and 300 grams of ⅛ inch (3.2 millimeter) diameter stainless steel shot. This mixture was then placed on a ball mill for 8 hours. Subsequently, 11 grams of MAKROLON 5705 was dissolved in 108.9 gm of methylene chloride, and 14.33 gm of the PTFE dispersion was added. This slurry was then placed on a shaker for 10 minutes. The resulting slurry was, thereafter, applied to the polyethylene naphthalate surface with a Bird applicator to form a anticurl layer having a wet thickness of 4.5 mil. The coating was dried at 120° C. for 1 minute in a forced air oven to form a dry layer having a thickness of 18 micrometer.

Example 3

A photoreceptor was prepared as in example 1 except the anticurl layer was prepared by providing a solution containing 11 gm of modified polycarbonate resin FPC0550UA available from Mitsubishi Gas Chemical Corporation and 0.92 gm PE1200 available from Bostick Inc, dissolved in 121 gm methylene chloride. This solution was thereafter applied to the polyethylene naphthalate surface with a Bird applicator to form an anticurl layer having a wet thickness of 4.5 mil. The coating was dried at 120° C. for 1 minute in a forced air oven to form a dry layer having a thickness of 18 micrometer.

Example 4

A photoreceptor was prepared as in example 3 except that the modified polycarbonate used was FPC0580UA available from Mitsubishi Gas Chemical Corporation.

Example 5

A photoreceptor was prepared as in example 3 except that the modified polycarbonate used was FPC0170UA available from Mitsubishi Gas Chemical Corporation.

Example 6

The viscosity of the solutions used to fabricate the anticurl layers in Examples 2, 3, 4 and 5 was measured using a Brookfield DV-II+viscometer. The measurement was made using a #2 spindle at a spindle speed of 30 RPM. Results are given in Table 2

TABLE 2

| Example # | Viscosity Centipoise |
|---|---|
| Control Example 2 | 810 |
| Example 3 | 238 |
| Example 4 | 920 |
| Example 5 | 613 |

The coefficient for friction of Examples 2, 4, and 5 was measured using a DYNISCO 5095D coefficient of friction tester.

The anticurl layer of photoconductive imaging members of Examples 2 ,4 and 5 were evaluated for adhesive properties using a 180° (reverse) peel test. The 180° peel strength is determined by cutting a minimum of three 0.5 inch×6 inches imaging member samples from each of Examples 2, 4, and 5. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width SCOTCH MAGIC Tape #810, available from 3M Company. In this condition, the anti-curl layer/substrate of the stripped segment of the test sample can easily be peeled away 180° from the sample to cause the anticurl layer to separate from the substrate. The end of the resulting assembly opposite to the end from which the anticurl layer is not stripped is inserted into the upper jaw of an INSTRON Tensile Tester. The free end of the partially peeled anti-curl/substrate strip is inserted into the lower jaw of the INSTRON Tensile Tester. The jaws are then activated at a 1 inch/min crosshead speed, a 2 inch chart speed and a load range of 200 grams to 180° peel the sample at least 2 inches. The load monitored is calculated to give the peel strength by dividing the average load required for stripping the anti-curl layer with the substrate by the width of the test sample.

The results of these tests are listed in the following Table 3.

TABLE 3

| Anticurl layer | Coefficient of Friction | Adhesion g/cm |
|---|---|---|
| Control Example 2 | 0.45 | 136 |
| Example 4 | 0.37 | 250 |
| Example 5 | 0.42 | 183 |

As shown in table 2, the anticurl layers in examples 4 and 5 give a solution viscosity within the range necessary for defect free coatings by extrusion. The 2 inventive examples in Table 3 give lower coefficient of friction than the PTFE containing control example. The two inventive examples also show improved adhesion over the control example.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An electrostatographic imaging member comprising:

a substrate with a conducting layer;

at least one imaging layer positioned on a first side of the substrate;

an anticurl backing layer positioned on a second side of the substrate opposite to the at least one imaging layer, wherein the anticurl backing layer includes a low surface energy modified polycarbonate polymer formed from a monomer selected from the group consisting of modified Bisphenol A polycarbonate poly(4,4'-isopropylidene diphenyl carbonate) and a modified Bisphenol Z polycarbonate poly (4,4'-diphenyl-1-1'cyclohexane carbonate), the polymer having a viscosity molecular weight of from about 39,000 to about 76,000 and a surface energy as measured by contact angle with water that is at least 95 degrees, and an optional adhesive promoter;

an optional over coating layer on the at least one imaging layer; and an optional ground strip layer on the at least one imaging layer.

2. The electrostatographic imaging member of claim 1, wherein the at least one imaging layer includes at least one charge generating layer and at least one charge transport layer.

3. The electrostatographic imaging member of claim 1, wherein the at least one imaging layer includes a dielectric electrographic imaging layer.

4. The electrostatographic imaging member of claim 1, wherein the anticurl backing layer has a thickness of between 2 microns to 50 microns.

5. The electrostatographic imaging member of claim 1, wherein the anticurl backing layer includes an adhesive promoter between 0.2% to 30% by weight of the anticurl backing layer.

6. The electrostatographic imaging member of claim 1, wherein the adhesive promoter is a copolyester.

7. The electrostatographic imaging member of claim 1, wherein the adhesive promoter is a linear copolyester resin comprising terephthalic acid, isophthalic acid and ethylene glycol, wherein a ratio of terephthalic acid to isophthalic acid is 3:2 and a ratio of the terephthalic and isophthalic acids to ethylene glycol is 1:1.

8. The electrostatographic imaging member of claim 1, wherein surface energy as measured by the contact angle with water is greater than 90 degrees.

9. A process for making an electrostatographic imaging member comprising:

providing a substrate with a conducting layer;

forming at least one imaging layer on a first side of the substrate;

forming an anticurl backing layer on a second side of the substrate opposite to the at least one imaging layer, wherein the anticurl backing layer includes a low surface energy modified polycarbonate polymer formed from a monomer selected from the group consisting of modified Bisphenol A polycarbonate poly(4,4'-isopropylidene diphenyl carbonate) and a modified Bisphenol Z polycarbonate poly (4,4'-diphenyl-1-1'cyclohexane carbonate), the polymer having a viscosity molecular weight of from about 39,000 to about 76,000 and a surface energy as measured by contact angle with water that is at least 95 degrees, and an optional adhesive promoter;

forming an optional over coating layer on the at least one imaging layer; and forming an optional ground strip layer on the at least one imaging layer.

10. The process of claim 9 further including forming the anticurl backing layer by extrusion of anticurl coating material through a single die nozzle onto the second side of the substrate layer.

11. The process of claim 9, wherein the at least one imaging layer includes at least one charge generating layer and at least one charge transport layer.

12. The process of claim 9, wherein the at least one imaging layer includes a dielectric electrographic imaging layer.

13. The process of claim 9, wherein the anticurl backing layer has a thickness of between 2 microns to 50 microns.

14. The process of claim 9, wherein the anticurl backing layer includes an adhesive promoter between 0.2% to 30% by weight of the anticurl backing layer.

15. The process of claim 9, wherein the adhesive promoter is a copolyester.

16. The process of claim 9, wherein the adhesive promoter is a linear copolyester resin comprising terephthalic acid, isophthalic acid and ethylene glycol, wherein a ratio of terephthalic acid to isophthalic acid is 3:2 and a ratio of the terephthalic and isophthalic acids to ethylene glycol is 1:1.

* * * * *